United States Patent [19]

Fling

[11] 4,428,216

[45] Jan. 31, 1984

[54] TUBE BENDER

[76] Inventor: Thomas A. Fling, 137 Northcreek Cir., Walnut Creek, CA 94598

[21] Appl. No.: 387,979

[22] Filed: Jun. 14, 1982

[51] Int. Cl.[3] ..... B21D 7/04

[52] U.S. Cl. ..... 72/156; 72/217

[58] Field of Search ..... 72/149, 156, 217, 218, 72/219, 387, 388, 409

[56] References Cited

U.S. PATENT DOCUMENTS 3,447,353 6/1969 Noveske ..... 72/217

3,735,621 5/1973 Dodge ..... 72/156

*Primary Examiner*—Francis S. Husar

*Assistant Examiner*—Charles Rosenberg

*Attorney, Agent, or Firm*—Robert Charles Hill

[57] ABSTRACT

A new and useful device for producing bends in metal tubing by containing the tubing in a form and rotating the form against a fixed shoe thereby bending and swagging the tubing to the shape of the form. The form being rotated by a ratchet and pawl mechanism which translates the linear motion of levers and linkage produced by the gripping force of the hand into circular motion of the form.

5 Claims, 7 Drawing Figures

FIGURE 4
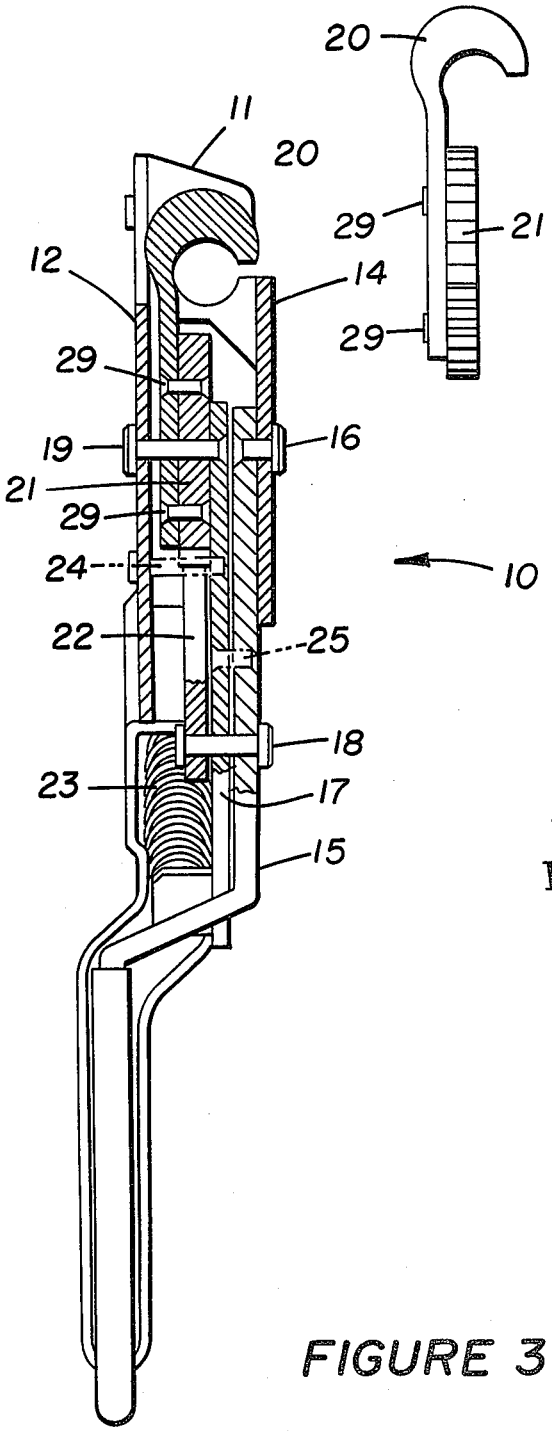
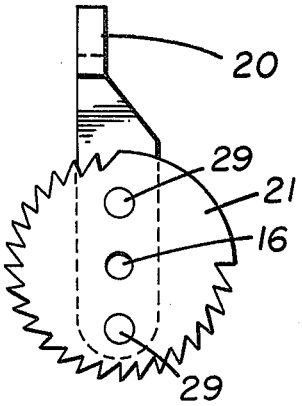
FIGURE 5
FIGURE 6
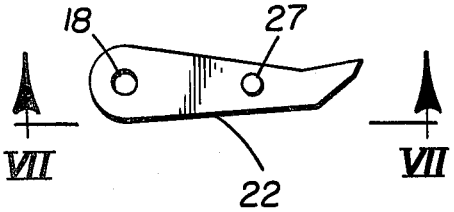
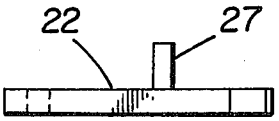
FIGURE 7
FIGURE 3

TUBE BENDER

This invention relates to a hand operated mechanism for bending metal tubing.

BACKGROUND OF THE INVENTION

Small diameter metal tubing is widely used for the transmission of fluids and fluid pressures from one device to another for the operation and control of numerous machines and processes. In connecting such devices the tubing is bent to conform to contours of equipment and structures. In bending tubing constraint must be placed on the side of the tubing to prevent flattening or kinking which would weaken the tube and interfere with the flow of fluid. Various kinds of benders are used for this application.

It has been know to bend tubing by wrapping the tubing around a form of the desired bend angle. It is also known that if the tubing is bent too sharply around a form, it will collapse upon itself and reduce its internal cross-section, thus reducing the tubing's effectiveness in carrying fluid or fluid pressure.

It is known to use tools that are effective in preventing kinking when bending tubing. Most such tools provide a guide for feeding the tubing through a bending form. Most of these tools are alike in that they produce the bend by swagging the tube in a circular form to the desired angle of bend; they differ in the means of rotating the form against the guide or shoe and in the method of inserting and removing the tube after bending.

The following patents are the prior art closest to the present invention known to the inventor:

U.S. Pat. No. 2,719,561—Bizak
U.S. Pat. No. 3,448,602—Stanley
U.S. Pat. No. 3,662,580—Power
U.S. Pat. No. 3,735,621—Dodge
U.S. Pat. No. 3,785,190—Schall

SUMMARY OF THE INVENTION

The present invention discloses a new and useful hand holdable mechanism for producing bends in metal tubing by containing the tubing in a form and rotating the form against a fixed guide or shoe, thereby bending and swagging the tubing to the shape of the form. The form is rotated by a ratchet and pawl mechanism which translates the linear motion of levers and linkages produced by the gripping force of the hand into circular motion of the form with respect to the shoe.

The tube bender here disclosed includes a circular form for constraining the tubing. The form is then caused to rotate against a shoe causing the tube to be swagged to the shape of the form to the angle desired. The form is rotated by a lever and ratchet assembly providing a high mechanical advantage permitting the large forces required for bending to be developed by small increments of rotation produced by opening and closing the handles of the bender using only the force developed by the hand. Releasing the handle entirely permits insertion or removal of the tube.

The objects and features of the invention should be readily apparent in light of the following specification and claims describing an embodiment of the invention.

BRIEF DESCRIPTION OF THE DRAWINGS

FIG. 3 is a sectional view taken generally along the lines III—III of FIG. 2.

FIGS. 4, 5, 6 and 7 are detail drawings of elements of the tube bender.

DESCRIPTION OF THE PREFERRED EMBODIMENT

Figure 1:
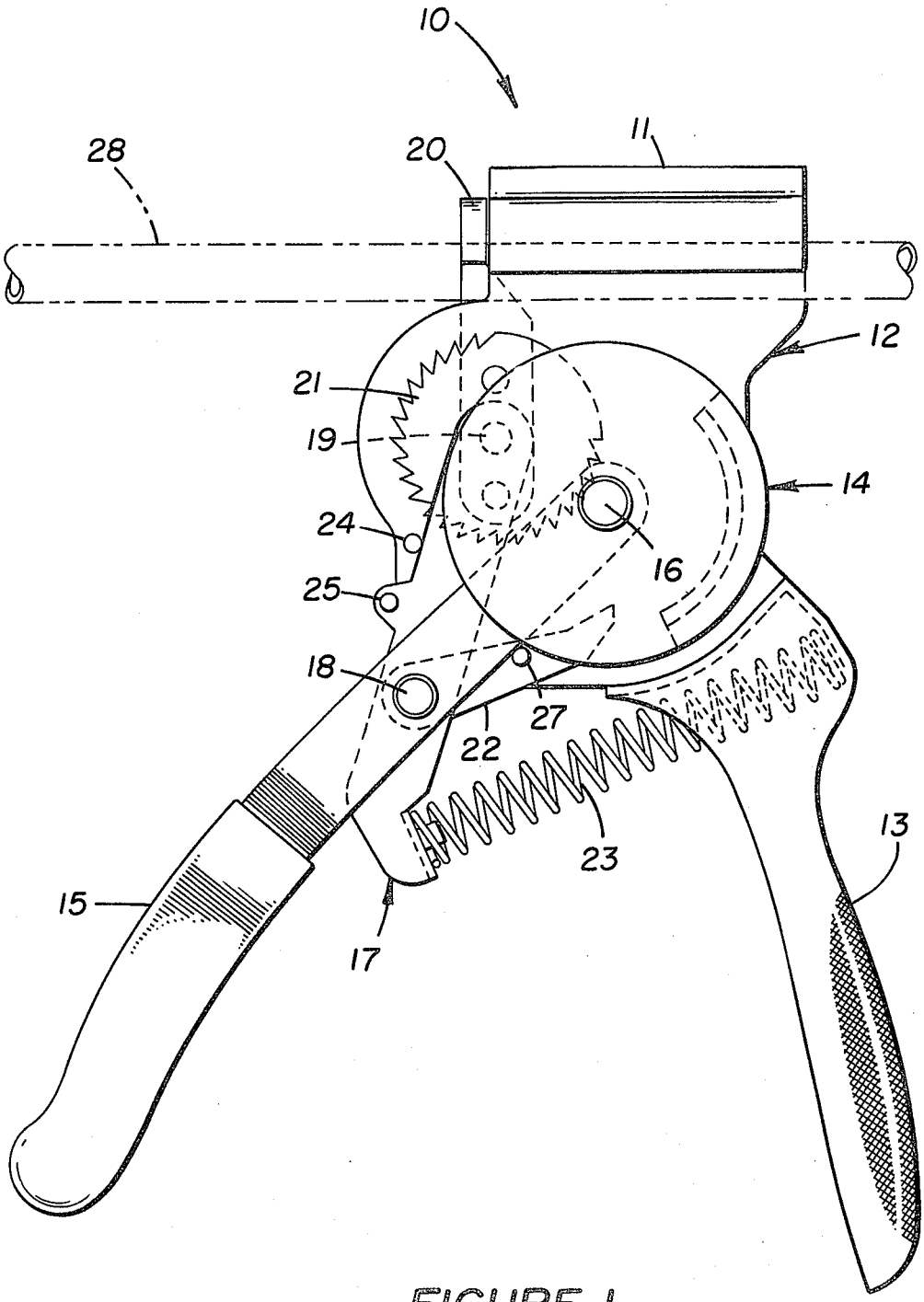
FIG. 1 is an assembly drawing of the tube bender showing parts of the assembly in dotted lines behind other parts.
Figure 2:
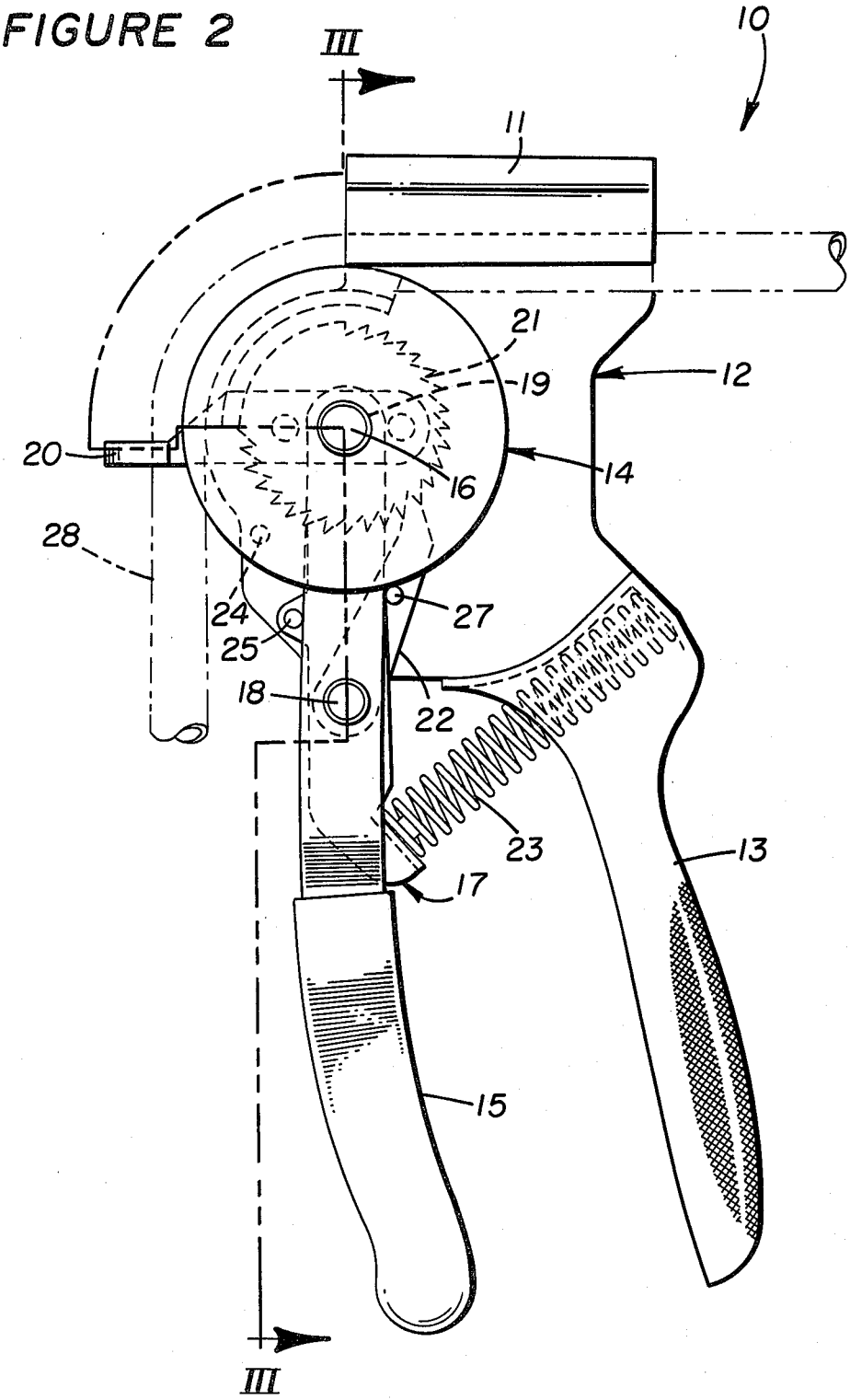
FIG. 2 is an assembly drawing showing the tube bender in position after completing a substantially 90° bend of a tubing.

Referring to the assembly drawings of FIGS. 1 and 2, the tube bender generally indicated 10 consists of a shoe 11 rigidly fixed to a frame member 12 which is also formed to establish a stationary handle 13 and a support for a central pin 19. A form 14 is attached to a movable handle 15 by means of hub pin 16 about which the form 14 rotates. The movable handle 15 is attached by the link pin 18 near one end of a link 17 which is attached on its other ends to the center pin 19 which establishes a center of rotation for elements of the tube bender 10. The distance between center pin 19 and the link pin 18 is the same as the distance between the link pin 18 and the hub pin 16 supporting form 14.

Thus when the hub pin 16 position is aligned with the center pin 19 position, the form 14 will rotate in a tangential path relative to the shoe 11. When pins 16 and 19 are not in alignment, the form 14 will not rotate and a tube may be inserted into or removed from the shoe 11.

The gripper 20 is supported on the center pin 19 and functions initially as a clamp to hold the tube securely in the form 14. The gripper 20 is fixed to by pins 29 (FIGS. 3–5) and is rotated with ratchet gear 21 which is supported on center pin 19 and is a part of a ratchet assembly which accomplishes rotation of the gripper 20 and gear 21. The gear 21 is rotated by a pawl 22 attached to the movable handle 15 by the same pin 18 which connects the movable handle 15 to the link 17. The pawl 22 rotates the gear 21 only when the center pin 19 and hub pin 16 positions coincide.

The movable handle 15 and link pin 18 are caused to oscillate about the center pin 19 by moving handle 15 toward stationary handle 13 by hand action. The handles are separated by opposing force of a main spring 23 connected between the stationary handle 13 and link 17. A stop pin 24 inserted in the frame 12 prevents excessive rotation of movable handle 15 about hub pin 16 and transfers further rotation about link pin 18 causing disengagement of the shoe 11. A stop pin 25 inserted in the link 17 prevents rotation of the handle 15 beyond the link 17 and insures alignment of the hub pin 16 and center pin 19 at the center of rotation.

A stop pin 27 as shown in FIGS. 6 and 7 in the pawl 22 causes the pawl 22 to disengage the ratchet gear 21 whenever the handle 15 is caused to rotate about link pin 18.

A tension spring, not shown, attached to the gripper 20 and frame 12 causes the gripper 20 to return to the position in contact with the shoe 11 whenever the ratchet pawl 22 is disengaged from ratchet gear 21. A flat circular spring, not shown, causes the pawl 22 to engage the ratchet gear 21 whenever the movable handle 15 is rotated with the form 14 about the center of rotation at pin 19. A flat circular spring, not shown, returns the form 14 to its starting position, as shown in dotted lines in FIG. 1, whenever the gripper 20 and tube 28 are disengaged from the form 14. A flat circular spring (not shown) attached to link 17 causes handle 15 to rotate clockwise about point 18.

A. Engaging the Tube

Referring first to FIG. 1, in the disengaged position link 17 is held against the stop pin 24 by action of the main spring 23 which operates in both tension and compression. Handle 15 is rotated and held against the stop pin 25 by action of the spring connected to handle 15 and link 17. This spring is not as strong as the main spring 23. Pawl 22 is disengaged from ratchet gear 21 by the handle 15 bearing on the pin 27. By disengagement of the pawl 22 from the gear 21, the gripper 20 is free to rotate to the vertical position against the shoe 11 by action of the not shown gripper spring. In this position the form 14 is moved down and away from the gripper 20 and shoe 11.

To engage the tube 28, the tube bender 10 is held in one hand by handles 13 and 15. The tube 28 is held in the other hand and inserted and held in the gripper 20 and shoe 11 while movable handle 15 is rotated about pin 18 by closing the grip of the hand. When the hub pin 16 is coincident with the center pin 19, further rotation of the handle about pin 18 is prevented by contact of the handle 15 with pin 25. In this position the handle 15 also disengages pawl pin 27 permitting engagement of the ratchet gear 21 and pawl 22.

B. Bending

Further force on handle 15 causes rotation of the handle 15, gripper 20 and form 14 about the center pin 19. The tube 28 which is held in the form 14 by the gripper 20 is swagged into the form 14 as the tube 28 is pulled through the shoe 11, the constraining action of the form 14 against the sides of the tube 28 ensure the tube remains approximately round during the bending process. Further bending is achieved by relaxing the grip of the hand, allowing the main spring 23 to return the handle 15 to a position to permit realignment of the pawl 22 and the ratchet gear 21. Reclosing the hand causes further rotation by action of the handle 15 and pawl 22 against the ratchet gear 21. This motion is continued until the desired angle of bend of tubing is achieved or contact of the tube 28 with the fingers of the hand prevents further rotation. With the tool design illustrated, this maximum angle will be 90°.

C. Disengaging the Bent Tube:

After achieving the desired angle of bend, the tube 28 is released from the bender by releasing handle 15 to the extended position, causing the handle to rotate about pin 18 after reaching stop pin 24 and moving the form 14 and tube 28 away from the gripper 20 and shoe 11, allowing the tube to be removed from the form 14. The rotation of the handle 15 further disengages the pawl 22 by contacting pin 27, permitting the gripper 20 to return to its starting position by action of its not shown spring. The form 14 is similarly returned to its starting position by action of its not shown spring.

While the invention has been described in its simplest form, the description is illustrative of the invention and is not to be construed as limiting the invention. Thus, it will be appreciated that various modifications and adaptations may occur to those skilled in the art without departing from the true spirit and scope of the invention as defined in the appended claims.

The subject matter to be claimed is:

1. A manually operable tube bender apparatus comprising:
   (a) a frame member establishing
      (i) a stationary handle,
      (ii) a shoe portion,
      (iii) and a supported center pin;
   (b) a link member including a link pin supported on said center pin, said link pin being spaced from said center pin on said link member;
   (c) a ratchet gear rotatably supported on said center pin and having a gripper member fixed thereto;
   (d) a movable handle rotatably supported on said link pin in cooperating alignment with said stationary handle;
   (e) a hub pin on said movable handle, said hub pin being spaced from said link pin support of said movable handle the same spacing as said space between said link pin and said center pin on said link member;
   (f) a form member rotatably supported on said hub pin;
   (g) a pawl member supported on said link pin and including a portion adapted to cooperate with said ratchet gear;
   (h) said link member and said moveable handle being movable to cause said hub pin to be axially aligned with said center pin and to cause said portion of said pawl to cooperate with said ratchet gear;
   (i) whereby movement of said movable handle toward said stationary handle causes movement of said gripper with respect to said shoe portion and said form member.

2. The apparatus of claim 1 wherein said gripper member and said form member include spaced cooperating portions adapted to engage a tube to be bent by said tube bender and to pull said tube through said shoe portion.

3. The apparatus of claim 2 including means causing said pawl to engage successive teeth of said ratchet gear as said movable handle is moved away from said stationary handle to cause rotation of said ratchet gear and gripper member with respect to said shoe portion as said movable handle is repeatedly moved toward said stationary handle.

4. The apparatus of claim 1 wherein means on said movable handle cooperating with a cut-out portion in said link member is moved with movement of said movable handle toward said stationary handle to cause said portion of said pawl to cooperate with said ratchet gear.

5. The apparatus of claim 1 wherein said pawl member includes a member engageable by said movable handle when said movable handle is moved away from said stationary handle to cause said portion of said pawl to be moved away from cooperation with said ratchet gear.

* * * * *